US005362959A

United States Patent [19]

Grossetie et al.

[11] Patent Number: 5,362,959

[45] Date of Patent: Nov. 8, 1994

[54] ULTRARAPID CAMERA FOR VISULAIZING THE INTENSITY PROFILE OF A LASER

[75] Inventors: Jean-Claude Grossetie, Ispra; Joseph-Albert Miehe, Strasbourg; Mustapha Boussoukaya, Bretigny sur Orge, all of France

[73] Assignee: European Economic Community (EEC), Plateau Du Kirchberg, Luxembourg

[21] Appl. No.: 94,061

[22] Filed: Jul. 28, 1993

[30] Foreign Application Priority Data

Jan. 30, 1991 [LU] Luxembourg ..... 87882

[51] Int. Cl.[5] ..... H01J 40/14

[52] U.S. Cl. ..... 250/214 VT; 313/529

[58] Field of Search ..... 250/214 VT, 207, 232; 313/528, 529, 525, 530, 537, 541, 544, 542

[56] References Cited

U.S. PATENT DOCUMENTS 4,868,380 9/1989 Booman et al. .
5,013,902 5/1991 Allard ..... 250/214 VT
5,221,836 6/1993 Kinoshita ..... 250/214 VT

FOREIGN PATENT DOCUMENTS 0127735 12/1984 European Pat. Off. .
2662036 11/1991 France .

OTHER PUBLICATIONS

IBM Technical Disclosure Bulletin, vol. 26, No. 12, May 1984, p. 6604.

*Primary Examiner*—David C. Nelms
*Assistant Examiner*—Que T. Le
*Attorney, Agent, or Firm*—Sughrue, Mion, Zinn, Macpeak & Seas

[57] ABSTRACT

The invention relates to an ultrarapid camera for visualizing the intensity profile of a laser pulse. This camera comprises in vacuum housing a photocathode, an extraction grid, focalization electrodes, deflection plates and a visualization screen. According to the invention, the electron emitting photocathode is constituted by at least one metal tip (3, 12) and means (9, 10) are provided to send said laser pulse (13) into a zone situated in front of said tip.

3 Claims, 1 Drawing Sheet

ULTRARAPID CAMERA FOR VISULAIZING THE INTENSITY PROFILE OF A LASER

The invention relates to a camera with ultrarapid slot scanning (streak camera) for visualizing the intensity profile of a laser pulse.

For the study of transitory phenomena, it is known to generate laser pulses of a very short duration of the order of $10^{-10}$ sec. The exact knowledge of the intensity profile of this pulse is very important in this case. Up to now, this is obtained by a slot scanning camera which comprises in a vacuum housing a photocathode, an extraction grid, focalization electrodes, deflection plates and a visualization screen. The laser pulse to be analyzed is applied through a transparent substrate of the photocathode, which, in reply, emits electrons. These electrons are then submitted to the electric field applied between the cathode and the extraction grid. They are accelerated, pass through a hole in a focalization anode and are finally deflected by deflection plates, which receive a sawtooth voltage. On the screen, the temporal distribution of the photons of the laser pulse which hit the photocathode can then be visualized.

A photocathode of the semiconductor type which is illuminated by light and which emits electrons in reply is described in document U.S. Pat. No. 4,868,380.

In document Appl. Phys. Lett. 45(4), Aug. 15, 1984, p. 307 to 309, there is described a metal photocathode onto which is directed a pulsed beam in order to extract electrons.

Finally, document EP-A-0 127 735 describes a photodetector in the shape of a plurality of metal pins which receives the light and produces a cathode current therefrom.

None of the above cited devices is able to visualize the intensity profile of the luminous pulse and in particular of an ultra-short pulse.

The object of the invention is a camera which permits to analyze pulses of a duration of less than $10^{-10}$ sec, i.e. having a temporal reply of one picosecond and even less.

This object is achieved according to the invention by replacing the semiconductor type photocathode by at least one metal tip and by sending the laser pulse into a zone situated in front of this tip.

As for embodiments of the invention, reference is made to the secondary claims.

The invention will now be described more in detail by means of an embodiment and the annexed drawings.

Figure 1:
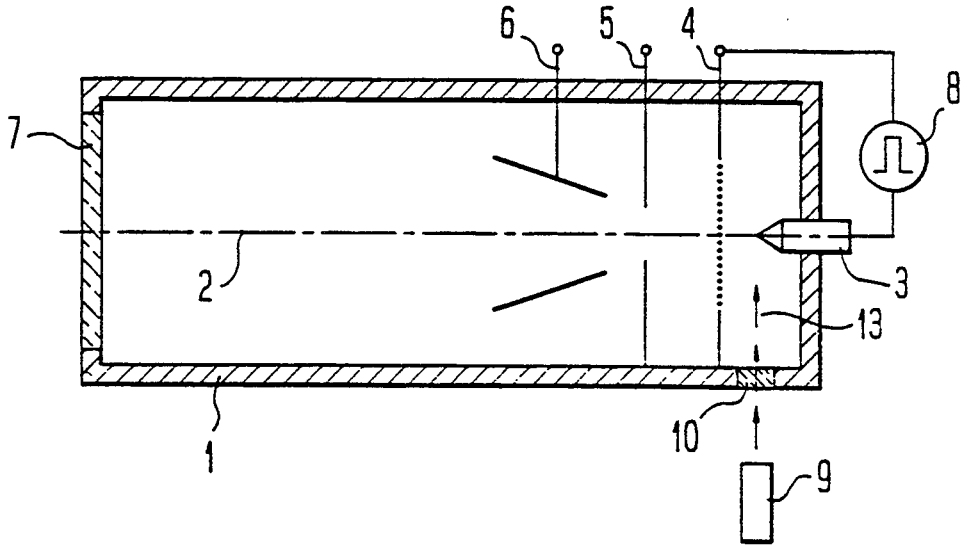
FIG. 1 shows diagrammatically an axial section view of a camera according to the invention.

FIG. 1 shows a housing 1 which is susceptible to be put under vacuum of about $10^{-8}$ Torr and which comprises, centred on an axis 2: a metal pin 3, an extraction grid 4, a focalization anode 5 with a central hole, deflection plates 6 and finally a visualization screen 7, made of phosphorus, for example. The various elements are connected to adequate electric voltage sources so as to ensure their respective conventional functions. In particular, the pin 3 is connected to a generator 8 of an electric pulse which is synchronized with the optical pulse to be analyzed. This latter pulse emerges from a laser 9 placed outside the housing 1 and directing its beam 13 through a window 10 towards a zone situated in front of the pin 3. The amplitude of the electric pulse supplied by the generator 8 is chosen slightly below a threshold at which a spontaneous emission of electrons from the pin is created.

This emission is finally only obtained by the simultaneous application of this electric pulse and of the optical beam supplied by the laser 9, the emission of electrons then corresponding rather precisely to the temporal profile of the optical pulse. Generating from only one laser an electric field of such an intensity that a tunnel effect and an electron emission are created, would require an important power rate of about 1.3 $10^{11}$W/cm$^2$, whereas the simultaneous action of the electric pulse and the optical pulse makes it possible that an optical power of the beam of the order of $10^5$W/cm$^2$ is sufficient to start the tunnel effect. The invention thus permits reduction of the power of the laser beam to be analyzed and thus improves the temporal resolution of the analysis.

Figure 2:
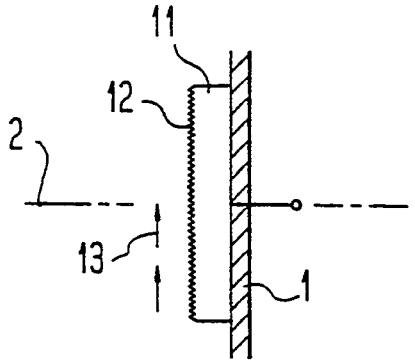
FIG. 2 represents a variant of the electron emitter according to FIG. 1.

FIG. 2 shows a variant with respect to the pin 3 of FIG. 1. It shows a substrate 11 of conductor metal which is connected, as before, to the generator 8 through the wall of the housing 1. This substrate comprises an emission surface 12 presenting a certain microscopic roughness, so that there are a plurality of tips susceptible to emit electrons. It has been observed that the emission threshold is substantially lower when the surface is rough, because the local electric field at the top of a pointed tip is of a factor B higher than the mean microscopic field around this tip; the factor B may attain $10^4$.

The invention is not limited to the embodiment described above. Thus, it is not mandatory that the laser beam intersects the axis 2 at 90°. By choosing for example an angle of 45° with the rough emission surface, an emission of a pulse type field accompanied by a photoemission is obtained. Further, the pulse generator 8 can be replaced by a source of continuous voltage, but in this case this voltage has to be reduced in order to avoid involuntary discharges prior to the start of the laser pulse.

We claim:

1. An ultrarapid camera for visualizing the intensity profile of a laser pulse, comprising, in a vacuum housing, a photocathode, an extraction grid, focalization electrodes, deflection plates and a visualization screen, said photocathode being disposed in opposition to said visualization screen and said extraction grid, said focalization electrodes and said deflection plates being disposed between said photocathode and said visualization screen, characterized in that the photocathode is constituted by at least one metal emission surface having at least one pointed tip formed thereon (3, 12) and means (9, 10) are provided for sending said laser pulse (13) into a zone situated in front of said at least one metal conductor.

2. A camera according to claim 1, characterized in that said metal emission surface has a plurality of said tips formed thereon to define a rough emission surface.

3. A method to implement the camera according to one of the preceding claims, characterized in that an electric extraction voltage is applied between the extraction grid and the tips, said extraction voltage being an electric pulse which defines a time based window around the laser pulse to be visualized, the amplitude of the electric pulse being slightly below that which is necessary to cause, by itself, an electron emission.

* * * * *